US010995922B2

(12) United States Patent
Moellers et al.

(10) Patent No.: US 10,995,922 B2
(45) Date of Patent: May 4, 2021

(54) LIGHTING DEVICE FOR A VEHICLE THAT ENABLES A VERTICAL SOFT TRANSITION OF LIGHT INTENSITY IN THE NEAR FIELD AND/OR FAR FIELD OF THE LIGHT DISTRIBUTION

(71) Applicant: HELLA GmbH & Co. KGaA, Lippstadt (DE)

(72) Inventors: Ingo Moellers, Rietberg (DE); Sebastian Nordhoff, Lippstadt (DE); Wolfgang Pohlmann, Lippstadt (DE); Wolf Alexander Quitsch, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/880,674

(22) Filed: May 21, 2020

(65) Prior Publication Data

US 2020/0370725 A1 Nov. 26, 2020

(30) Foreign Application Priority Data

May 21, 2019 (DE) ..... 102019113480.3

(51) Int. Cl.

| | |
|---|---|
| ***F21S 41/176*** | (2018.01) |
| ***F21S 41/25*** | (2018.01) |
| ***F21S 41/153*** | (2018.01) |
| *F21Y 115/10* | (2016.01) |
| *F21W 102/20* | (2018.01) |

(52) U.S. Cl.
CPC ..... *F21S 41/176* (2018.01); *F21S 41/153* (2018.01); *F21S 41/25* (2018.01); *F21W 2102/20* (2018.01); *F21Y 2115/10* (2016.08)

(58) Field of Classification Search
CPC ..... F21S 41/176; F21S 41/153; F21S 41/25
See application file for complete search history.

(56) References Cited

U.S. PATENT DOCUMENTS 9,739,458 B2 8/2017 Miyachi et al.

FOREIGN PATENT DOCUMENTS

DE 10 2012 100 140 A1 7/2013
EP 3 026 705 A1 7/2013

*Primary Examiner* — Joseph L Williams
(74) *Attorney, Agent, or Firm* — Muncy, Geissler, Olds & Lowe, P.C.

(57) ABSTRACT

A lighting device for a vehicle, in particular headlights for a vehicle, having a plurality of light sources, from which light is emitted during operation of the lighting device, projection optics for projecting the light, and a generator for generating a light distribution in the exterior of the vehicle, which has a soft transition in the vertical direction from a central region to the near field and/or the far field of the light distribution. The generator has a plurality of converters which change the wavelength spectrum of the light emitted from the light sources. The lighting device being designed in such a way that during operation of the lighting device, at least one first region of at least one of the converters is subjected to a greater luminous flux density of the light emitted from the light sources as a second region of the at least one converter.

15 Claims, 3 Drawing Sheets

LIGHTING DEVICE FOR A VEHICLE THAT ENABLES A VERTICAL SOFT TRANSITION OF LIGHT INTENSITY IN THE NEAR FIELD AND/OR FAR FIELD OF THE LIGHT DISTRIBUTION

This nonprovisional application claims priority under 35 U.S.C. § 119(a) to German Patent Application No. 102019113480.3, which was filed in Germany on May 21, 2019, and which is herein incorporated by reference.

BACKGROUND OF THE INVENTION

Field of the Invention

The present invention relates to a lighting device for a vehicle, in particular a headlight for a vehicle.

Description of the Background Art

Lighting devices can offer new applications with regard to the light distribution of a headlight, in particular by using light emitting diodes (LEDs) in a matrix arrangement. A lighting device known from the conventional art is illustrated schematically in FIGS. 7 to 11. This lighting device comprises a plurality of light sources 1, which are designed as light emitting diodes, and primary optics 2. In front of each light source, a part 3 of the primary optics 2 is arranged through which the light of the corresponding light emitting diode passes. The lighting device further comprises a lens 4 serving as the projection optics for projecting the light emitted from the primary optics 2 into the exterior space of the vehicle. The primary optics 2 are used, among other things, to generate a vertical soft discharge of the light intensity in the near field and/or in the far field of the light distribution, or when using high beams.

FIGS. 9 to 11 demonstrate that the light emitting diodes serving as light sources 1 are arranged in a matrix at equal distances from one another. To the right in FIG. 11, the direction is plotted which corresponds to the vertical direction in the light distribution in the exterior space of the vehicle. In the lower part of FIG. 11, lateral boundaries 5 are shown which separate the individual light emitting diodes from one another in the lateral direction. In the upper diagram in FIG. 11, for example, the current 6 flowing through the individual light emitting diodes or a duty factor of a pulse width modulation or the like is plotted upwards. In the middle diagram, the light current 7 emitted by the light emitting diodes is plotted upwards. It can be seen that in the case of light sources 1 at the edge (cf., for example, the light source arranged on the right in FIG. 11), a lower current 6, which also leads to a lower luminous flux 7, is used to produce a soft discharge of the light intensity.

A disadvantage of such a lighting device is that high-precision adjustment of the primary optics is required. In addition, increased installation space must be provided for such a lighting device.

A lighting device is known from EP 3 026 705 A1, which corresponds to U.S. Pat. No. 9,739,458. In the lighting device described therein, light emitting diodes in a matrix arrangement are also used as light sources. In order to generate a vertical soft discharge of the light intensity in the near field and/or in the far field of the light distribution or when using high beams, more light emitting diodes are provided at the upper and/or lower end of the matrix than in a central region. In particular, several light emitting diodes are connected in series and the individual rows of the matrix of light emitting diodes are gradually dimmed. This allows for the light distribution to be discharged more softly. Furthermore, there is no need for complex primary optics.

However, it turns out to be disadvantageous in such a lighting device that more matrix rows or additional light emitting diodes are required in order to generate the discharge. Corresponding logic modules that take up additional space on a circuit board must also be kept available to be able to individually control the individual rows of the matrix. The unbundling of the feeds to the individual pixels of the matrix also becomes significantly more complex. For example, multi-layer printed circuit boards may be necessary. Ultimately, an observer could perceive a discharge by the projection of individual, increasingly dimmed pixels as digital and possibly as disturbing.

SUMMARY OF THE INVENTION

It is therefore an object of the present invention to provide a lighting device with simple means which enables a vertical, soft discharge of the light intensity in the near field and/or in the far field of the light distribution.

In an exemplary embodiment, it is provided that a generator for generating a light distribution comprise a plurality of converters which change the wavelength spectrum of the light emitted from the light sources, the lighting device being designed such that at least a first region of at least one of the converters during operation of the lighting device is subjected to a greater luminous flux density of the light emitted from the light sources than a second region of the at least one converter. It may be provided here that the light sources are formed as light emitting diodes and arranged in two mutually perpendicular directions next to each other so as to form a matrix arrangement. In particular, the at least one first region and the at least one second region of the at least one converter may be arranged next to each other in one direction, which corresponds to the vertical direction in the light distribution. This design allows for a smooth, gradual discharge of the light distribution of pixelated light sources using simple projection optics without the utilization of complex primary optics, which require increased space and a high adjustment effort. The resulting gradual decrease in light intensity along the luminous surface creates a stepless exit of the light distribution when projected onto the street, without having to provide additional light emitting diodes and modules or having to change the optimal aspect ratio of the lighting device that meets the requirements.

It may be provided that at least one, preferably each, of the converters is formed such that when the light emitted from one of the light sources is incident on a converter, a first portion of the light is converted by the converter to light having a different wavelength and a second portion of the light passes through the converter, especially such that overall a substantially white light impression is formed. For example, the light source can emit blue light and the converter can convert a portion of the light emitted from the light source to yellow light, which then, combined with the blue light component passed through the converter, conveys a white light impression.

There is the possibility that the light emitted from each of the light sources at least partially is incident on one of the converters. In particular, each of the light sources can be associated with one of the converters in such a way that the light emitted from the light source is incident on the associated converter. Preferably, at least a first converter has a greater extension than at least one second converter, wherein the extension of the first converter is greater in the direction which in the light distribution corresponds to the vertical direction. In this case, the extension of the first converter in the direction corresponding to the vertical direction in the light distribution can be more than twice the extension of the second converter in the direction corresponding to the vertical direction in the light distribution. If at the same time the at least one first converter is arranged asymmetrically with respect to the associated light source and in particular, the at least one second converter is arranged symmetrically to the associated light source, this will result in a soft continuous discharge of the light distribution in the vertical direction of the light distribution. The geometry of the converters in the upper and/or lower row in front of a matrix of light emitting diodes can be adjusted accordingly to meet the requirements. In this case, the desired aspect ratio of the lighting device can be retained. At the same time, light sources and control components can be saved. If converters are extended in a vertical direction, while the light emitting chip or the plurality of light emitting diodes remain at the lower/upper side, the desired inhomogeneous distribution of the luminous flux along the illuminating surface is obtained. This is due to the fact that with increasing distance, for example, from the blue-emitting light emitting diode, increasingly less light is coupled out or is converted, yet the light discharge is not hindered by an interface. In the horizontal direction, however, a sharp demarcation may also be provided to meet the contrast requirements.

There is the possibility that at least one of the converters, in particular each converter, at least partially surrounds the assigned light source. For example, at least one of the converters, in particular each converter, can be designed as a potting compound. Alternatively, it can be provided that at least one of the converters, in particular each converter, is at least partially spaced apart from the associated light source.

There is the possibility that at least one of the light sources, in particular each light source, is surrounded by lateral boundaries. In particular, the lateral boundaries can at least partially be at a greater distance from the light source associated with the at least one first converter than the lateral boundaries from the light source associated with the at least one second converter. As a result, the light discharge at the upper and/or lower edge is not or only insignificantly impeded by at least one extended first converter.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 3:
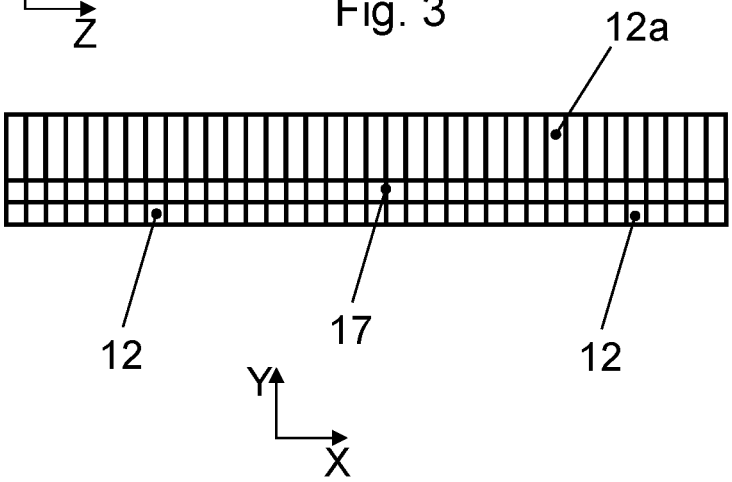
FIG. 3 is a plan view of the light sources of the lighting device according to FIG. 1.
Figure 4:
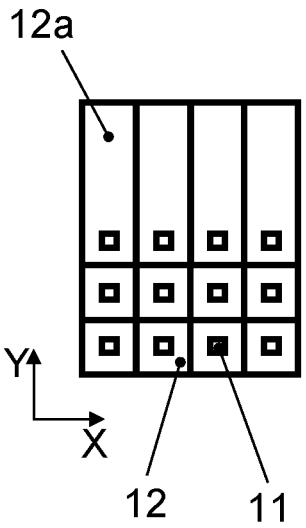
FIG. 4 is a detail of FIG. 3.

The exemplary embodiment of a lighting device according to the invention shown in FIGS. 1 to 6 comprises a plurality of light sources 11 which are arranged next to one another in a matrix arrangement in two mutually perpendicular directions (cf., for example, FIG. 4). The light sources 11 can in particular be embodied as light emitting diodes which emit blue light essentially in the Z direction of the coordinate systems shown.

A converter 12 is arranged in front of each of the light sources 11 in the Z direction and converts a part of the light 13 emitted from the light sources 11 into yellow light, for example, in a manner known per se, so that overall an essentially white light impression is produced. The converter 12 can surround the light source 11 assigned to it. It can surround the light source 11 in particular as a potting compound. Alternatively, the converter 12 can also be spaced apart from the associated light source 11.

Figure 1:
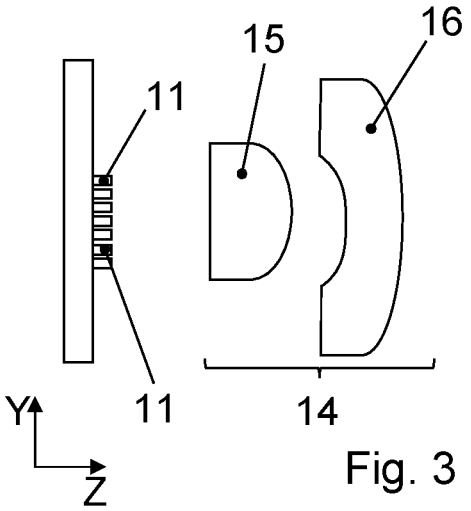
FIG. 1 is a side view of a lighting device according to the invention.
Figure 2:
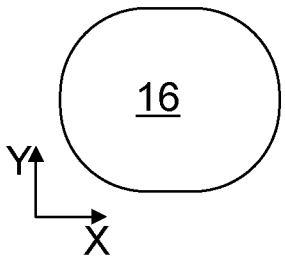
FIG. 2 is a front view of the lighting device according to FIG. 1.

The lighting device further comprises projection optics 14, having two lenses 15, 16 successively arranged in the direction of extension of the light 13 emitted from the light sources 11 or in the Z direction in FIG. 1. Due to the elimination of primary optics as in the prior art described in FIGS. 7 to 11, the projection optics 14 can be made smaller, so that overall a more compact structure of the lighting device is produced (cf. the front view in FIG. 2).

The converters 12 are of different sizes in the embodiment shown in FIGS. 1 to 6. In particular, the converters 12*a* at the upper edge of the matrix in the Y direction are larger than the converters 12 arranged further below (cf., for example, FIGS. 3 and 4). This is demonstrated particularly in FIG. 5 and FIG. 6, where a first converter 12*a* on an edge side in the Y direction is about three times as large in the Y direction than a second converter 12*b* arranged next to it. The Y direction in the light distribution corresponds to the vertical direction.

Figure 5:
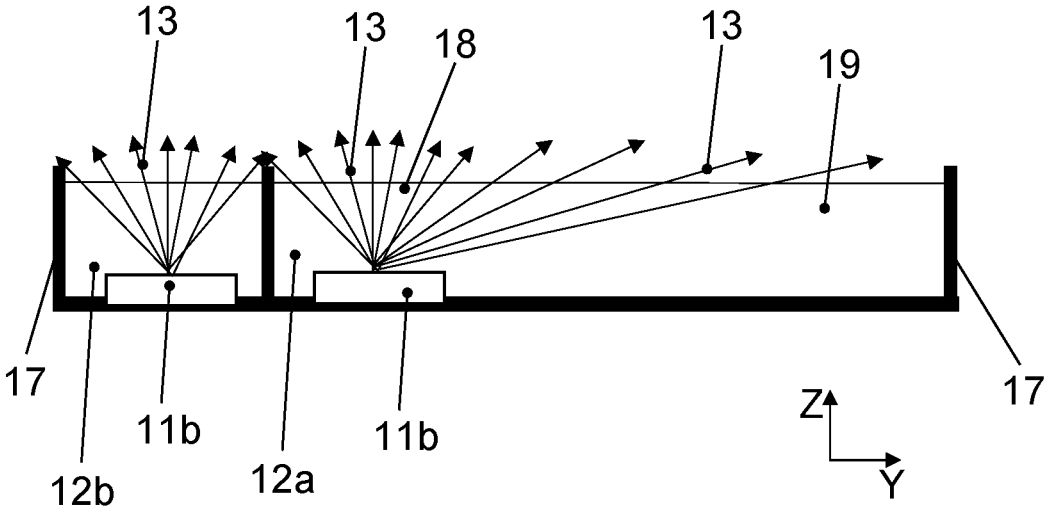
FIG. 5 is a side view of a detail of the light sources according to FIG. 3 with light emitted from them.
Figure 6:
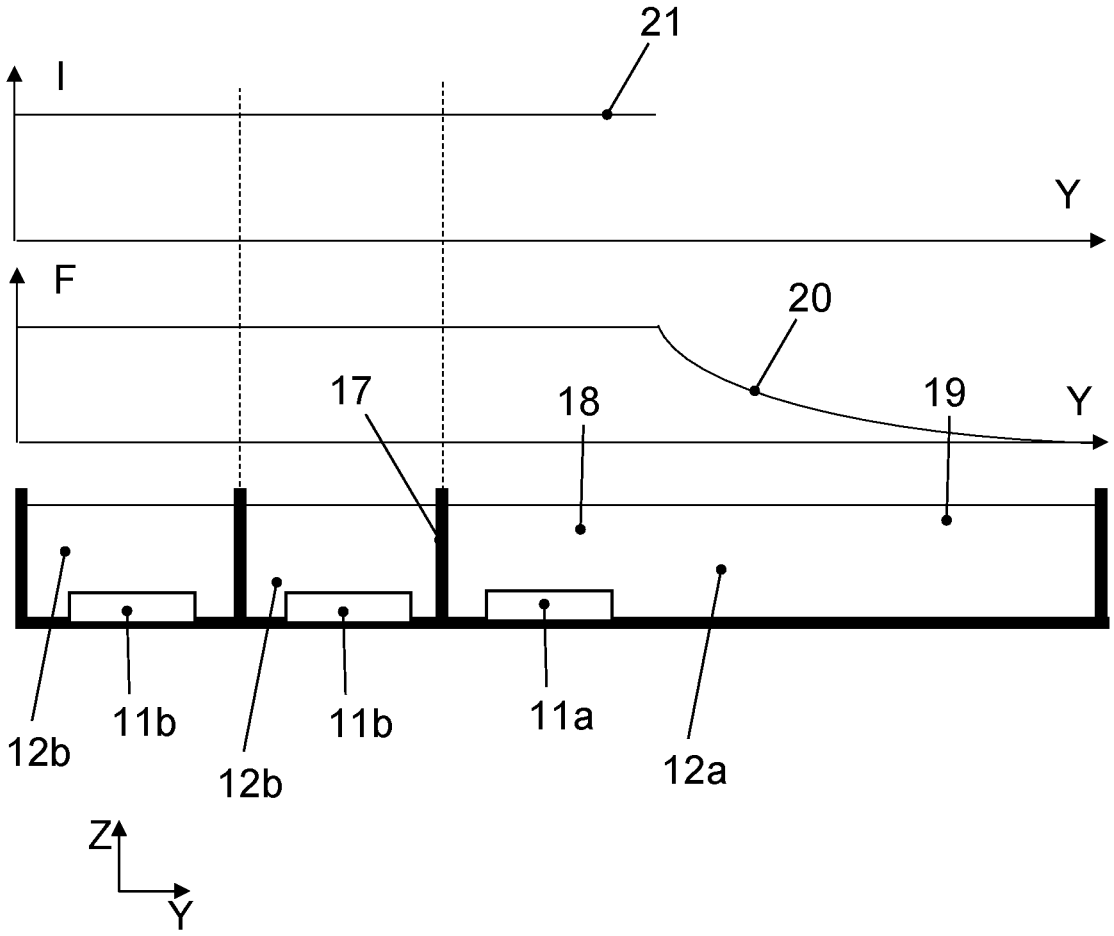
FIG. 6 is a side view of a detail of the light sources according to FIG. 3 with an illustration of the luminous flux and the control of individual light sources.
Figure 7:
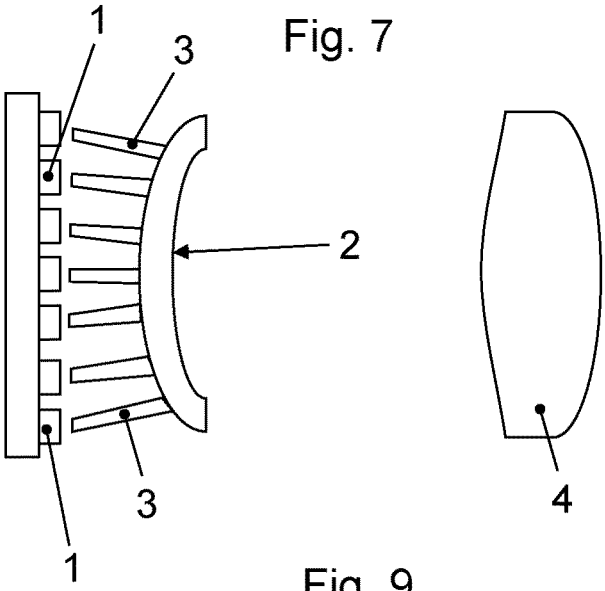
FIG. 7 is a side view of a lighting device according to the prior art.
Figure 8:
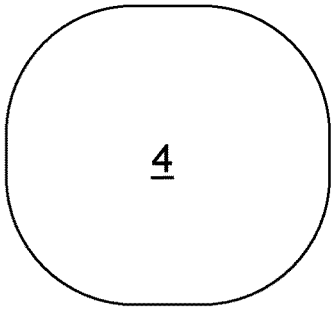
FIG. 8 is a front view of the lighting device according to FIG. 7.
Figure 9:
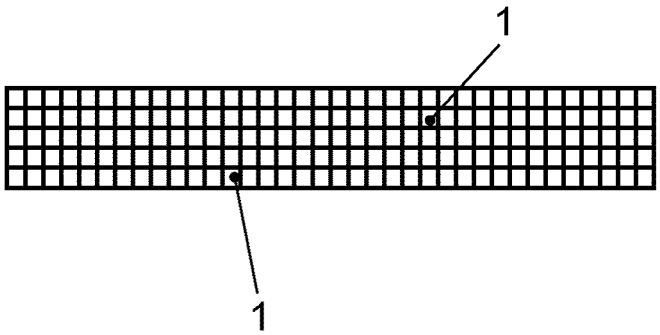
FIG. 9 is a plan view of the light sources of the lighting device according to FIG. 7.
Figure 10:
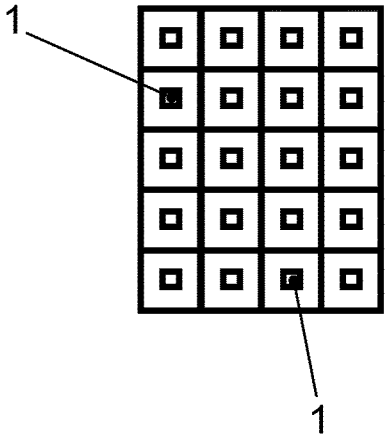
FIG. 10 is a detail of FIG. 9.
Figure 11:
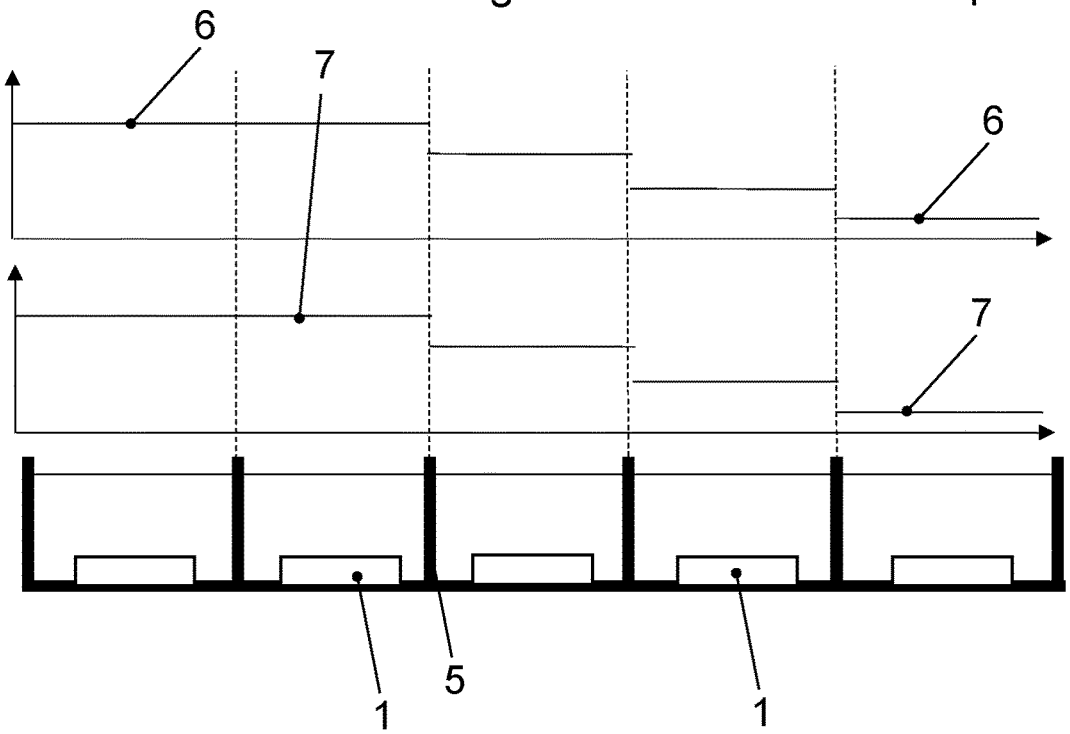
FIG. 11 is a side view of a detail of the light sources according to FIG. 9 with an illustration of the luminous flux and the control of individual light sources.

FIGS. 5 and 6 illustrate that lateral boundaries 17 are provided between the individual light sources 11*a*, 11*b* and between the individual converters 12*a*, 12*b*. In this case, the outer light source 11*a* in the Y direction in FIG. 5 and FIG. 6 is substantially arranged at the left edge of the space formed by the two lateral boundaries 17, so that the light source 11*a* is arranged only under the left or first region 18 of the associated extended converter 12*a*, whereas no light source is provided under the right or second region 19 of the converter 12*a*.

FIG. 5 illustrates that due to this arrangement of the light source 11*a* relative to the converter 12*a*, the first region 18 of the converter 12*a* is subjected to a greater luminous flux density of the light 13 emitted from the light source 11*a* than the second region 19 arranged further to the right in FIG. 5. In the middle diagram, FIG. 6 shows the corresponding luminous flux F as a function of the Y direction, which corresponds to the vertical direction in the light distribution. It can be seen that in the transition from the first to the second region 18, 19 of the converter 12*a*, the luminous flux 20 drops off gently.

With the extended converter 12*a* and the selected arrangement of the light source 11*a* to the converter 12*a*, the desired soft vertical discharge of the light intensity can thus be made possible. A corresponding design with an extended converter 12*a* and a corresponding arrangement of the light source 11*a* to the converter 12*a* can be provided both above and below in FIGS. 3 and 4 or both in the near field and in the far field of the light distribution.

The upper diagram of FIG. 6 shows the current I which flows through each light source 11*a*, 11*b* to be designed as a light emitting diode or a duty ratio of a pulse width modulation or the like, as a function of the Y direction. It was shown that the same current 21 can flow through all the light emitting diodes, so that the control of the light emitting diodes is simplified.

FIG. 3 shows that all converters 12 are of equal size in the horizontal direction or in the X direction, wherein the individual converters 12 are separated from one another by corresponding lateral boundaries 17 in order to maintain the contrast in the horizontal direction.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting device for a vehicle, in particular headlights for a vehicle, the lighting device comprising a plurality of light sources from which light is emitted when the lighting device is operated;

projection optics for projecting the light emitted from the light sources into an exterior space of the vehicle; and generator for generating a light distribution in the exterior space of the vehicle, which has a soft transition in the vertical direction from a central region to the near field and/or to the far field of the light distribution, the generator for generating a light distribution comprising a plurality of converters that change a wavelength spectrum of the light coming from the light sources, wherein the lighting device is configured such that during operation of the lighting device, at least one first region of at least one of the converters is subjected to a greater luminous flux density of the light emitted from the light sources than a second region of the at least one converter.

2. The lighting device according to claim 1, wherein the at least one first region and the at least one second region are arranged side by side in a direction which corresponds to the vertical direction in the light distribution.

3. The lighting device according to claim 1, wherein the light sources are arranged next to one another in two mutually vertical directions so that they form a matrix arrangement.

4. The lighting device according to claim 1, wherein the light sources are light emitting diodes.

5. The lighting device according to claim 1, wherein at least one of the converters is formed such that when the light emitted from one of the light sources is incident on a converter, and wherein a first portion of the light is converted into light with a different wavelength by the converter and a second portion of the light passes through the converter such that overall a substantially white light impression emerges.

6. The lighting device according to claim 1, wherein the light emitted from each of the light sources at least partially is incident on one of the converters.

7. The lighting device according to claim 1, wherein each of the light sources is assigned to one of the converters such that the light emitted from the light source is incident on the associated converter.

8. The lighting device according to claim 1, wherein at least one first converter has a greater extension than at least one second converter, the extension of the first converter in the direction being greater, which corresponds to the vertical direction in the light distribution.

9. The lighting device according to claim 8, wherein the extension of the first converter in the direction (Y), which corresponds to the vertical direction in the light distribution, is more than twice as great as the extension of the second converter) in the direction (Y), which corresponds to the vertical direction in the light distribution.

10. The lighting device according to claim 8, wherein the at least one first converter is arranged asymmetrically with respect to the associated light source, or wherein the at least one second converter is arranged symmetrically to the associated light source.

11. The lighting device according to claim 7, wherein at least one of the converters at least partially surrounds the associated light source.

12. The lighting device according to claim 11, wherein at least one of the converters is designed as a potting compound.

13. The lighting device according to claim 7, wherein at least one of the converters is at least partially spaced apart from the associated light source.

14. The lighting device according to claim 1, wherein at least one of the light sources is surrounded by lateral boundaries.

15. The lighting device according to claim 14, wherein the lateral boundaries between the light source associated with at least one first converter are at least partially at a greater distance than the lateral boundaries to the light source associated with the at least one second converter.

* * * * *